US011718431B2

(12) United States Patent
Medford

(10) Patent No.: US 11,718,431 B2
(45) Date of Patent: Aug. 8, 2023

(54) SYSTEM AND APPARATUS HAVING A TEMPERATURE-CONTROLLED WORK AREA AND METHOD OF MAKING AND USING SAME

(71) Applicant: Packaging Coordinators, LLC, Philadelphia, PA (US)

(72) Inventor: Steven J. Medford, Monroe Center, IL (US)

(73) Assignee: ANDERSONBRECON INC., Rockford, IL (US)

( * ) Notice: Subject to any disclaimer, the term of this patent is extended or adjusted under 35 U.S.C. 154(b) by 190 days.

(21) Appl. No.: 17/248,864

(22) Filed: Feb. 11, 2021

(65) Prior Publication Data

US 2021/0323704 A1 Oct. 21, 2021

Related U.S. Application Data

(60) Provisional application No. 63/013,057, filed on Apr. 21, 2020.

(51) Int. Cl.

| | |
|---|---|
| ***B65B 31/02*** | (2006.01) |
| ***B65B 57/00*** | (2006.01) |
| ***B65B 31/00*** | (2006.01) |

(52) U.S. Cl.

CPC ..... *B65B 31/025* (2013.01); *B65B 31/00* (2013.01); *B65B 57/00* (2013.01)

(58) Field of Classification Search

CPC ..... B65B 31/025; B65B 57/00; B65B 3/003; B65B 67/02; B65B 31/00

See application file for complete search history.

(56) References Cited

U.S. PATENT DOCUMENTS

| | | | | |
|---|---|---|---|---|
| 2,055,158 A * | 9/1936 | Rice, Jr. | F25D 3/12 | 62/424 |
| 4,304,293 A | 12/1981 | Rau | | |
| 4,510,169 A | 9/1985 | Linner | | |
| 5,197,301 A * | 3/1993 | Holcomb | F24F 5/0017 | 62/457.1 |
| 6,282,916 B1 * | 9/2001 | Price | F25D 3/125 | 62/250 |

(Continued)

OTHER PUBLICATIONS

International Search Report and Written Opinion of PCT/US2021/012921, dated May 12, 2021.

(Continued)

*Primary Examiner* — Thomas M Wittenschlaeger
*Assistant Examiner* — Katie L Gerth
(74) *Attorney, Agent, or Firm* — Mark T. Vogelbacker; Eckert Seamans Cherin & Mellott, LLC

(57) ABSTRACT

A portable packing table having a temperature-controlled work area is provided. The table defines a chamber for dry ice or like substance and has a surface on which an open-topped upright chimney is mounted for receiving a flow of conditioned air from the chamber and for defining a temperature-controlled work area therein. A fan unit is connected to the table for forcing a flow of ambient air into the chamber, and a control unit is connected to the fan unit for automatically controlling operation of the fan unit to maintain air temperature within the chimney within a set temperature range.

11 Claims, 10 Drawing Sheets

(56) References Cited

U.S. PATENT DOCUMENTS 6,336,341 B1 * 1/2002 McGraw ..... F25D 1/00 62/425
6,354,104 B1 * 3/2002 Feagin ..... A61B 10/0096 70/68
6,571,568 B1 * 6/2003 Link ..... B60H 1/3235 62/421
6,571,574 B1 * 6/2003 Blackstone ..... F24F 5/0017 62/421
6,971,249 B1 * 12/2005 Blackstone ..... A41D 13/0055 62/421
7,178,357 B2 * 2/2007 Link ..... B60H 1/00264 62/457.7
7,188,489 B2 * 3/2007 Martello ..... B60H 1/3235 62/457.1
7,603,875 B2 * 10/2009 Carr ..... F24F 5/0017 62/425
7,748,235 B1 * 7/2010 Franklin ..... F24F 5/0017 62/414
7,984,624 B2 * 7/2011 Leitner ..... B60H 1/3235 62/420
9,084,477 B2 * 7/2015 Westbrook ..... A47B 37/04
10,107,548 B2 * 10/2018 Mize ..... F25D 1/02
10,307,761 B2 * 6/2019 Schryver ..... F25D 3/125
10,436,464 B1 * 10/2019 Headrick ..... F25D 3/125
10,845,065 B1 * 11/2020 Rosario ..... F04D 1/025
2005/0016199 A1 * 1/2005 Blackstone ..... F24F 5/0017 62/421
2008/0016885 A1 * 1/2008 Hoover ..... A63J 5/025 62/50.2
2013/0216213 A1 * 8/2013 Thomas ..... F24H 9/0063 165/104.34
2014/0033759 A1 2/2014 Ide et al.
2015/0204598 A1 * 7/2015 Affleck ..... B65B 3/003 220/560.04
2016/0143270 A1 * 5/2016 Schryver ..... F21V 21/096 220/560.04
2017/0042385 A1 2/2017 Babikian et al.
2019/0336345 A1 12/2019 Bannwart
2019/0366345 A1 * 12/2019 Schryver ..... C12M 45/22

OTHER PUBLICATIONS

Invitation to Pay Additional Fees and, Where Applicable, Protest fees issued in corresponding PCT/US2021/012921, dated Mar. 16, 2021.

* cited by examiner

SYSTEM AND APPARATUS HAVING A TEMPERATURE-CONTROLLED WORK AREA AND METHOD OF MAKING AND USING SAME

CROSS-REFERENCE TO RELATED APPLICATION

The present application claims priority to U.S. Provisional Application No. 63/013,057, filed Apr. 21, 2020 and titled "PACKING TABLE HAVING TEMPERATURE-CONTROLLED WORK AREA," the entire disclosure of which is hereby incorporated by reference in its entirety.

FIELD

The present application relates generally to handling temperature-sensitive products, and more particularly, to preparing, packing, and/or labeling temperature-sensitive products and/or their containers, such as vials or the like, in an efficient and effective manner and/or without subjecting the user or working to the harsh environment of a freezer or cold room.

BACKGROUND

Various temperature-sensitive products require packaging in containers, such as vials, bottles, test tube, and the like (such as those for drug reconstitution). These containers are produced in many different sizes, shapes, and configurations, and must be properly prepared, packaged, and/or labeled prior to distribution to patients. Temperature-sensitive products can include, for example, medical products, pharmaceuticals, vaccines, injectable medications, biologics, biological materials or samples, blood, blood plasma, cells including stem cells, bone marrow, donor organs, tissue products and samples, plasma concentrates, reagents (including standards and controls) used to assay biological functions, specimens, chemical products, food products, and other thermally-sensitive articles, that must be kept within predetermined temperature ranges during packaging and/or labeling of filled packaging.

It is conventional practice to fill and/or label such products and their packaging within a relatively large, walk-in freezer or cold room (e.g., meat locker) in which the worker filling or labeling vials or the like must be physically located for extended periods of time. Accordingly, the worker is required to remain within and be exposed to the harsh environment and temperature within the freezer for these periods. As an example of a relatively harsh temperature for a worker, some products requiring packing or labeling to occur in cold rooms in which room temperature is maintained at or about −20° C. (−4° F.).

SUMMARY

It is, of course, undesirable for a worker to remain in the above-described conditions for an extended period of time, such as the time required to properly package the products. It would be desirable to develop a device and/or method to allow a working to package temperature-sensitive products without being required to be located in such a freezer or cold room. It would also be desirable to condition and/or circulate air to allow for preparing, packing, and/or labeling temperature-sensitive products in an efficient and effective manner.

The device and methods of the presently disclosed technology overcome the above and other drawbacks of the prior art.

In one embodiment, the presently disclosed technology includes a device and method to allow labeling of containers in an approximately −20° C. (−4° F.) environment without requiring staff to work inside of a freezer.

According to one embodiment of the presently disclosed technology, the presently disclosed technology includes a portable packing table having a temperature-controlled work area. The table can include a chamber for dry ice or other cooling agent and has a surface on which an open-topped upright chimney can be mounted for receiving a flow of conditioned air from the chamber and for defining a temperature-controlled work area therein. A fan unit can be connected to the table for forcing a flow of ambient air into the chamber, and a control unit is connected to the fan unit for automatically controlling operation of the fan unit to maintain air temperature within the chimney within a set temperature range.

According to another embodiment, the presently disclosed technology is directed to a system configured to allow a user to prepare or package temperature-sensitive product without requiring the user to enter a harsh environment. The system can include a table defining an insulated chamber configured to hold a temperature-controlling substance, a lid removably attachable to a top of the table to enclose the chamber, the lid including an opening extending therethrough, and a chimney surrounding the opening and extending upwardly from the lid.

Yet another embodiment of the presently disclosed technology is directed to a method of preparing or packaging temperature-sensitive product in a room within a temperature range of 16-27° C. The method can include placing a temperature-controlling substance in an insulated chamber of a table. The temperature-controlling substance can be configured to cool the insulated chamber to minus 20° C., or optionally between minus 10° C. to minus 30° C. The method can further include placing a lid on top of the table, activating a fan unit to circulate air from outside the table to inside the insulated chamber, placing a container holding temperature-sensitive product into an area defined by a chimney extending upwardly from the lid of the table, and placing a label on the container while the container is positioned in the area defined by the chimney.

BRIEF DESCRIPTION OF THE DRAWINGS

The foregoing summary, as well as the following detailed description of the presently disclosed technology, will be better understood when read in conjunction with the appended drawings, wherein like numerals designate like elements throughout. For purposes of illustrating the presently disclosed technology, there are shown in the drawings various illustrative embodiments. It should be understood, however, that the presently disclosed technology is not limited to the precise arrangements and instrumentalities shown. In the drawings.

DETAILED DESCRIPTION

Figure 1:
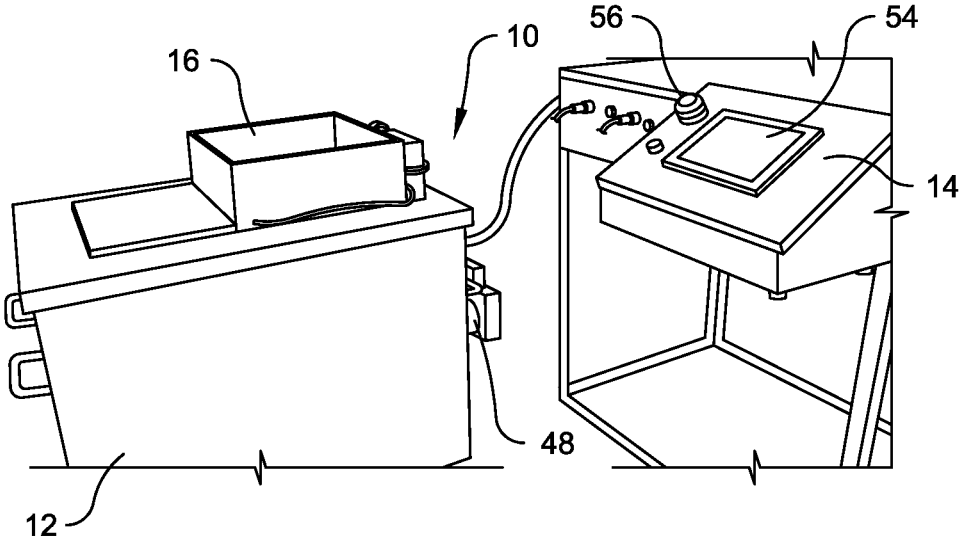
FIG. 1 is a perspective view of a portable packing table and a control unit for packing and/or labeling vials or the like in accordance with one embodiment of the presently disclosed technology.
Figure 2:
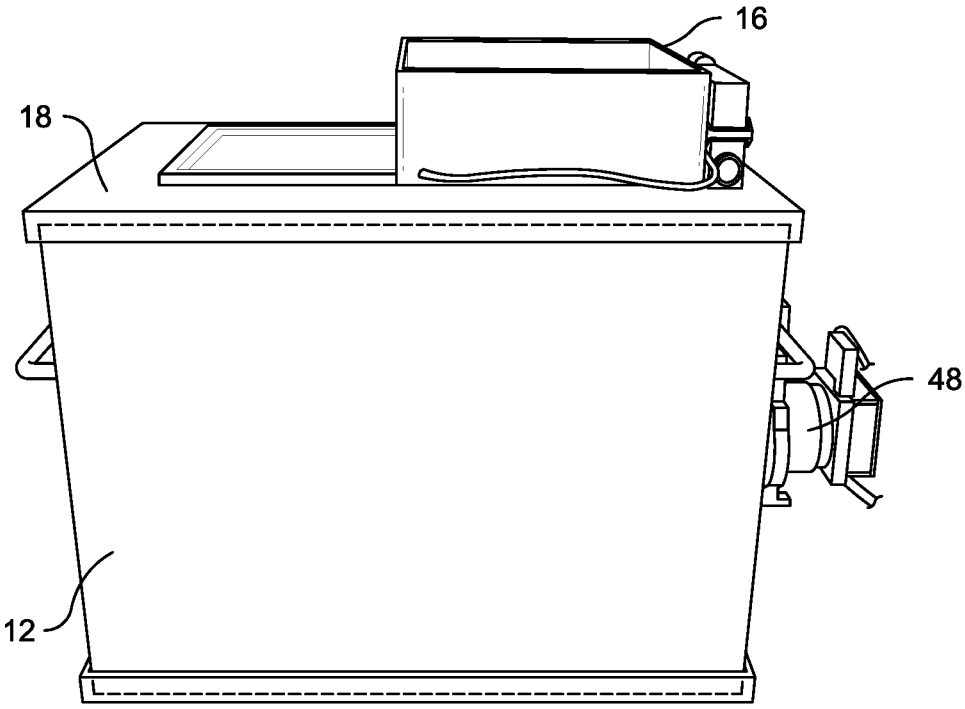
FIG. 2 is perspective view of the packing table of FIG. 1.

While systems, devices and methods are described herein by way of examples and embodiments, those skilled in the art recognize that the presently disclosed technology is not limited to the embodiments or drawings described. Rather, the presently disclosed technology covers all modifications, equivalents and alternatives falling within the spirit and scope of the appended claims. Features of any one embodiment disclosed herein can be omitted or incorporated into another embodiment.

Any headings used herein are for organizational purposes only and are not meant to limit the scope of the description or the claims. As used herein, the words "can" and "may" are used in a permissive sense (i.e., meaning having the potential to) rather than the mandatory sense (i.e., meaning must). Unless specifically set forth herein, the terms "a," "an" and "the" are not limited to one element but instead should be read as meaning "at least one." The terminology includes the words noted above, derivatives thereof and words of similar import. A person of skill in the art would understand that the specific temperatures and temperature ranges provided here can be modified, depending upon the needs of the particular situation.

Embodiments disclosed herein include work areas, tables, surfaces or stations (often collectively referred to herein as "tables") that enable handling, processing, packing, labeling and like activities for temperature-sensitive products. These tables are optionally portable or movable. Typically, handling, processing, packaging, labeling, and the like would be carried out in a large, walk-in freezer or cold room, which subjects a worker's entire body to the harsh environment and temperature maintained in the freezer or cold room. This can reduce the effectiveness and/or efficiency of the worker, and the length of time the worker can perform the desired task. This can also increase the time it takes and associated costs to complete the task. Simply for purposes of example and not by way of limitation, such cold room temperature may be maintained at or approximately −20° C. (−4° F.), such as between −15° C. and −25° C., or between 0° C. and −60° C. Of course, this varies depending upon the particular temperature-sensitive product being handled, packed and/or labeled.

In contrast to conventional practices, embodiments disclosed herein provide a portable work area, table, surface, or station that enables product handling, processing, packing, labeling, and/or the like to be accomplished in less harsh conditions, such as within rooms maintained or conditioned at normal or ambient room temperatures that are comfortable for the worker. Simply for purposes of example and not by way of limitation, such conditioned or ambient room temperature may be about 20° C. (68° F.), or optionally between 60-85° F.

Referring now in detail to the drawings, wherein like reference numerals refer to like parts throughout, according to one embodiment of the presently disclosed technology, FIGS. 1-6, 10, 11, and 13-15 show a system or apparatus, generally designated 10, that can include a table 12 configured to provide a work surface to a user. The table 12 can optionally be movable and/or portable, as described below. Optionally, the table 12 can be configured to be interconnected, operatively connected, and/or electrically connected to a control unit 14. However, the apparatus 10 is not limited to a separate table 12 and control unit 14, as the functionality of both can be built into a single device.

In one embodiment, the control unit 14 can be portable or movable, and can be movable with respect to the table 12. In use, the table 12 and/or the control unit 14 can be located in a room or area maintained at a temperature or within a temperature range that is either comfortable or tolerable to the user (e.g., but not limited to, at 68° F., or optionally between 65-71° F., or optionally between 62-73° F., or optionally between 58-78° F.) as compared to the harsh temperatures within a freezer or cold room.

Optionally, the table 12 includes a solid top surface or lid 18. In one embodiment, the lid 18 can be removably attached to a body or vertical sidewalls of the table 12, such that the lid 18 can be completely separated from a remainder of the table 12. At least a portion of the lid 18 can define a planar work surface for the user that can be an area maintained at a desired temperature required for temperature-sensitive products being handled. The lid 18 or a portion thereof can be transparent.

In one embodiment, at least a portion of the table 12 can include a least one opening and/or open-topped chimney 16 extending through and/or upwardly from the lid 18. Optionally, to handle the temperature-sensitive products and containers thereof, only the gloved or otherwise covered hands of a worker are need to be extended within the open-topped chimney 16 and be exposed to harsh temperatures within the interior of the table 12. This allows the user or worker to be more comfortable and safer while labeling, for example, the containers holding the temperature-sensitive product.

Figure 3:
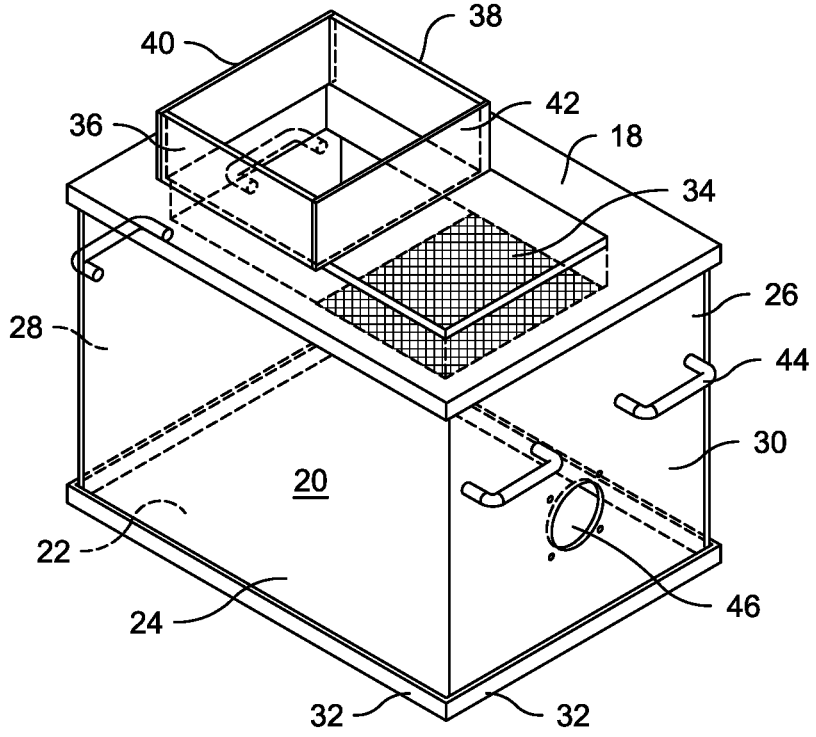
FIG. 3 is another perspective view of the packing table of FIG. 1, where a fan unit is omitted for clarity only.

As best shown in FIG. 3, the table 12 is optionally generally or completely hollow and defines, holds, surrounds, and/or supports an insulated chamber or cavity 20 therein for containing dry ice, for example, or other temperature-controlling substances, such as but not limited to ice, ice packs, or products manufactured by THERMO-CON™. By way of example only, the table 12 may be generally rectangular having a base wall 22, opposed side walls 24 and 26, opposed end walls 28 and 30, and the removable lid or top wall 18. The base wall, side walls and end walls of the table may be interconnected by numerous flanges, brackets or other connectors 32 and may be made of a material that provides an amount of insulation. The lid 18 is able to be removed from the other walls defining the table 12 to expose and permit access to the chamber 20 (e.g., to insert dry ice) and then is able to be replaced onto the other walls of the table 12 to close the chamber 20.

In one optional embodiment, the insulated chamber can be removably inserted or placed into the walls 24, 26, 28, 30 of the table 12. The insulated chamber can have a length of 29 inches, a width of 20 inches, and a height of 23 inches. The wall thickness can optionally exceed 3.5 inches. Optionally, the volume of the insulated chamber can be 2 cubic feet. The insulated chamber can optionally be manufactured by Bonar Plastics.

In one embodiment, the chimney 16 is located on and/or over a part of the lid 18 that has an opening, thereby permitting conditioned, forced air exiting the chamber 20 to flow up, into and through only the area defined by the chimney 16 and not through other parts of the lid 18. Optionally, a removable layer, surface, screen, filter, or other work surface 34 extends near or along the base or bottom of the chimney 16 and permits conditioned air to pass upwardly from the chamber 20 and into the area defined by the chimney 16. The screen 34 may also extend on, in, or over parts of the lid 18 extending outwardly beyond the perimeter of the chimney 16.

Optionally, the screen 34 extends parallel to the lid 18 and at least slightly above the lid 18. However, in one embodiment, the lid 18 is solid and closed beneath the portion of the screen 34 that is positioned outside of the chimney 16. In such a configuration, the flow of conditioned air from the chamber 20 is limited to passing only into the area defined by the chimney 16 via the lid 18.

Figure 6:
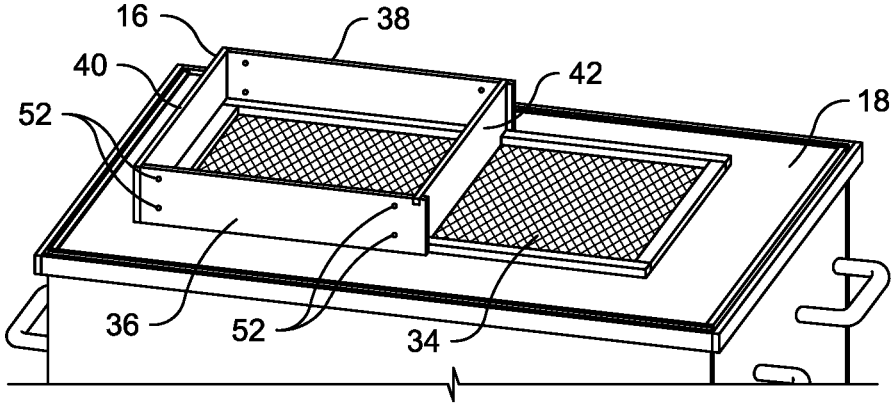
FIG. 6 is another perspective view of the top surface of the packing table of FIG. 1.
Figure 7:
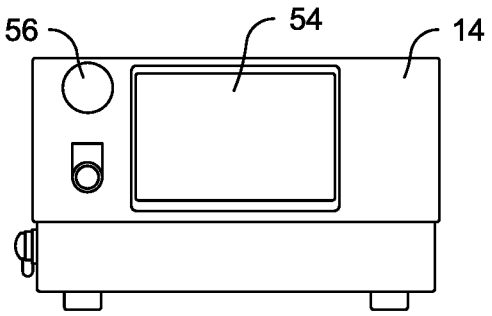
FIG. 7 is a front elevation view of a control unit of FIG. 1.

According to one embodiment, as shown in FIG. 6, the chimney 16 defines an area or volume surrounded by opposed upright and planar side walls 36, 38 and opposed upright end walls 40, 42. The height of the walls 36, 38, 40, 42 may be equal, and may be in the range of 4-12 inches above the lid 18. Of course, the height of the walls 36, 38, 40, 42 can be greater or smaller depending upon the size of the vials, temperature-sensitive product, or other items being handled on the table 12. The end wall 42 of the chimney 16 may be capable of being slid upwardly to permit vials, temperature-sensitive products, or the like placed on a part of the screen 34 extending outside of the chimney 16 to be slid into the area defined by the chimney 16. The end wall 42 could then be slid downward to be closed. In one embodiment, and interior surface of each side wall 36, 38 includes a groove sized and shaped to reactive at least an end portion of one of the end walls 42 therein. Alternatively, the vials, temperature-sensitive product, or the like may be positioned within the chimney 16 through its open top (i.e., over the walls 36, 38, 40, 42 and into the area defined by the chimney 16). Optionally, one or more of the walls 36, 38, 40, 42 can be transparent or translucent. Alternatively, one or more of the walls 36, 38, 40, 42 can be opaque or light-blocking.

Figure 4:
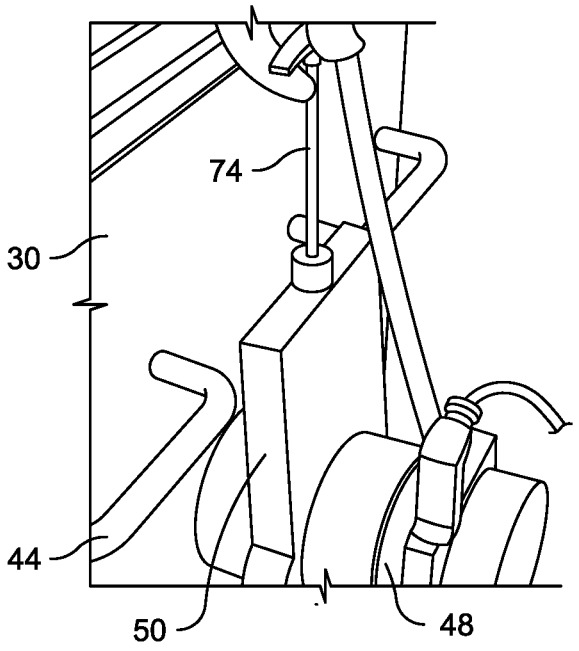
FIG. 4 is a magnified view of an end wall of the packing table of FIG. 1 including a replaceable fan unit and air valve.
Figure 5:
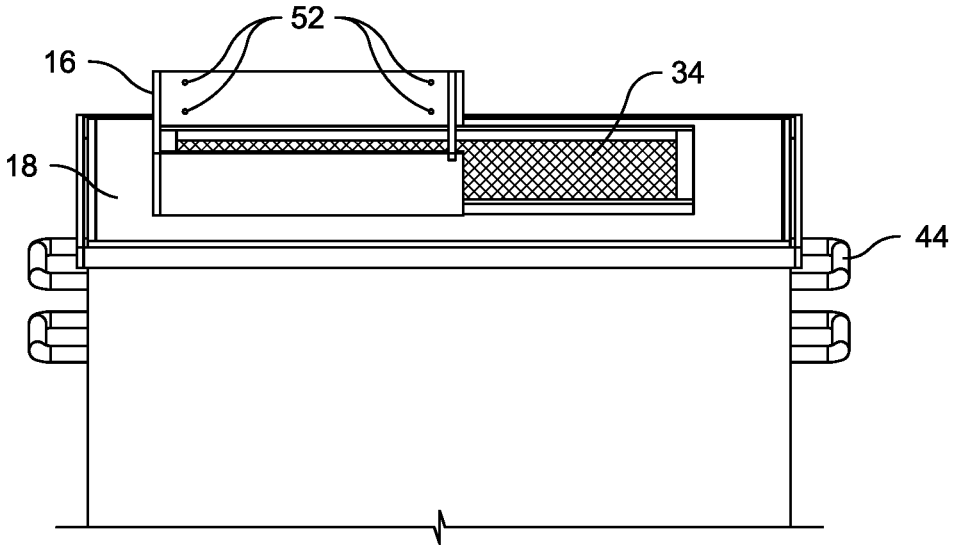
FIG. 5 is a perspective view of a top surface of the packing table of FIG. 1.

As shown in FIGS. 3-5, each of the end walls 28, 30 of the table 12 can include one or more handles 44 for lifting and positioning the table 12, as desired. In addition, the end wall 30 of the table 12 can include an ambient air intake opening 46 (see FIG. 3) in which a fan unit 48 (see FIG. 4) can be mounted and/or operatively connected. The air intake opening 46 is optionally cylindrical in cross-section and positioned to receive a flow of ambient air into the chamber 20 of the table 12, such that the air flows through dry ice or like substance contained within the chamber 20 before the conditioned-air is forced through the lid 18 and chimney 16. The air intake opening 46 can optionally have a circular shape and be located below the handle(s) 44 on the end wall 30.

Optionally the fan unit 48 includes a rotating fan blade or other air flow inducing mechanism for directing and forcing a flow of ambient air into the chamber 20, and thus, through the dry ice or like substance contained within the chamber 20. Accordingly, the ambient air caused to flow into the chamber 20 is conditioned and exits the chamber 20 via the chimney 16 at a greatly reduced temperature.

According to one embodiment, as shown in FIG. 4, the fan unit 48 or the table 12 includes a valve or door 50 for use in opening or closing the air-intake opening 46 of the chamber. Thus, the air-intake opening 46 can remain closed during the loading of the chamber 20 with dry ice or like substance and only be opened when the fan unit 48 is to be initially turned on to force a flow of ambient air into the chamber 20. The valve 50 can be opened by manual vertically lifting of a handle 74, as shown in FIG. 4. Likewise, the valve 50 can be closed by moving the handle 74 downwardly in a linear manner. Of course, other types of values may be utilized, such as a rotatable valve. The fan unit 48, including a fan and valve combination, may be readily removable from the air-intake opening 46 and replaceable with a replacement fan unit, should replacement be needed or desired. Alternatively, the fan unit 48 can be removed from the table 12 for storage, transporting, or repair.

The control unit 14 can be configured to operatively control the fan within the fan unit 48. For instance, the control unit 14 can be used to turn the fan on or off and can be used to automatically control the speed of rotation of a fan blade or a rate of air flow produced to maintain a desired set temperature within the chimney 16. In addition, the control unit 14 receives information from one or more sensors 52 mounted on the chimney 16, and can be configured to provide feedback to the user.

Figure 11:
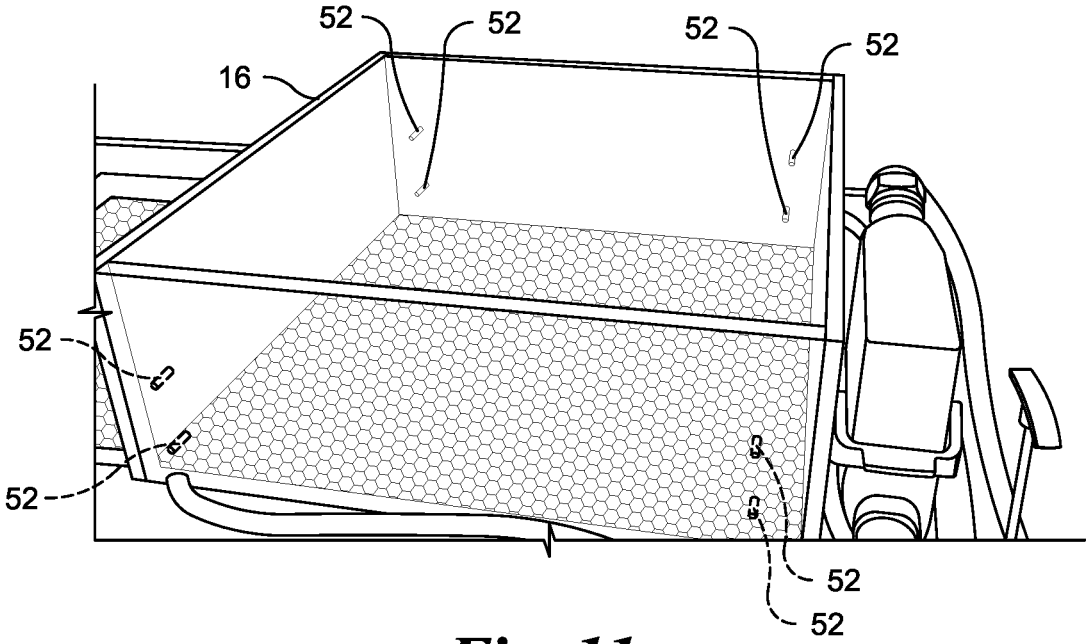
FIG. 11 is magnified view of a portion of the packing table of FIG. 1.

By way of example, as shown in FIGS. 5, 6, and 11, the chimney 16 may have one or a plurality of (e.g., eight separate) temperature sensors 52 mounted on one or more of the walls 36, 38, 40, 42 of the chimney 16. The temperature sensors 52 can, for example, be configured to provide temperature information to the control unit 14 of the current temperature within the work area defined by the chimney 16. By way of one example, each sensor 52 may be configured to sense temperature within the chimney 16 ten times per second.

In one optional embodiment, each sensor 52 only returns temperature feedback or data to the control unit 14 and provides no other functionality. In that case, each sensor 52 is a Resistance Temperature Detector (RTD), where the resistance of each sensor 52 changes as its temperature changes. For example, the resistance of each sensor 52 can increase as the temperature of each sensor 52 increases. These type of sensors are passive devices. The temperature range of each sensor 52 can be modified by the user, as desired.

Optionally, the sensors 52 may only be mounted on the side walls 36, 38 of the chimney 16, and not the end walls 40, 42. In one embodiment, as shown in FIG. 11, the sensors 52 may include two sensors 52 located adjacent each corner of the chimney 16 with one sensor 52 located near the lower edge of the chimney 16 and the other located near a mid-height of the chimney 16.

As shown in FIGS. 5, 6, and 11, in one optional embodiment, the sensors 52 can be arrange so that two sensors 52 are located at or near the interior of each corner of the chimney 16, with one of the two sensors 52 being placed vertically above or higher than the other. Thus, in each corner, one sensor 52 can be located high and another sensor 52 can be located low. With such an arrangement, the table 12 and/or the sensors 52 can be operated off of the average of the four low sensors, or the average of the four high sensors, or the average of all eight sensors. Because conventional containers have a variety of heights, sizes, and/or configurations, the sensors can be operated in a manner to most efficiently and accurately measure temperature at the appropriate level or height for a given container or set of containers placed within the chimney 16 and/or on top of the screen 34 within the chimney 16.

Optionally, as shown in FIGS. 1 and 7-9, the control unit 14 includes a display screen 54 and a visual or audible indicator, such as light 56. The display screen 54 may be a touch screen, LCD or other screen, and can be used with another device to set operation parameters and show the status of the system. The light 56 may be lit to inform the worker that the temperature within the chimney 16 has not yet reached the set point temperature and, when off, may indicate to the worker that the work surface is ready for use. Of course, other indicators may be used.

Figure 8:
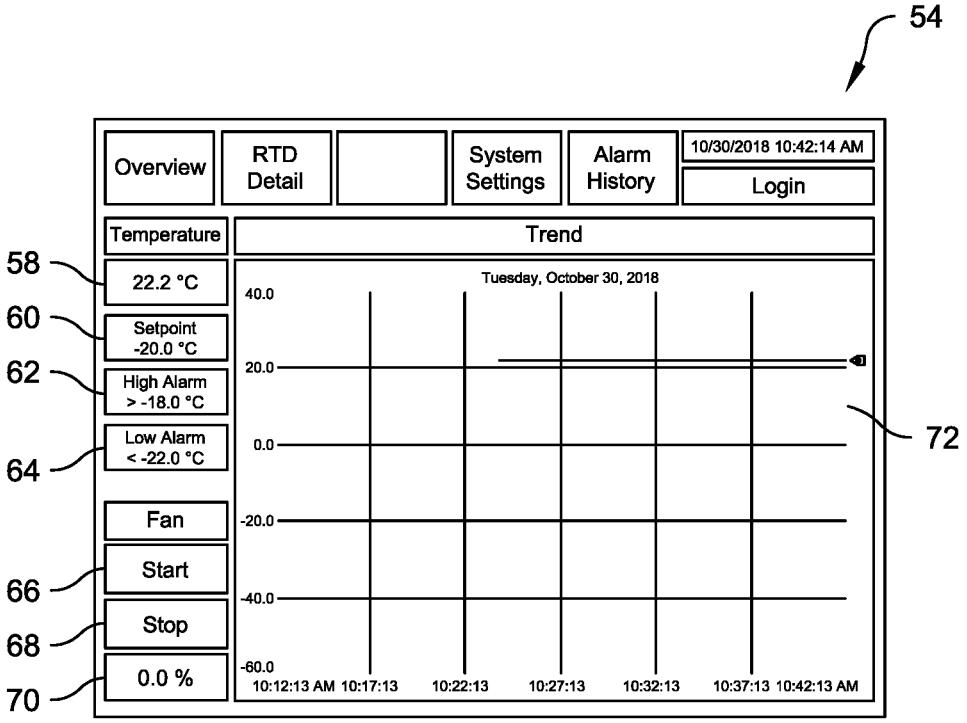
FIG. 8 is a graphical user interface of the control unit of FIG. 1 before the fan is started in accordance with one embodiment of the presently disclosed technology.
Figure 9:
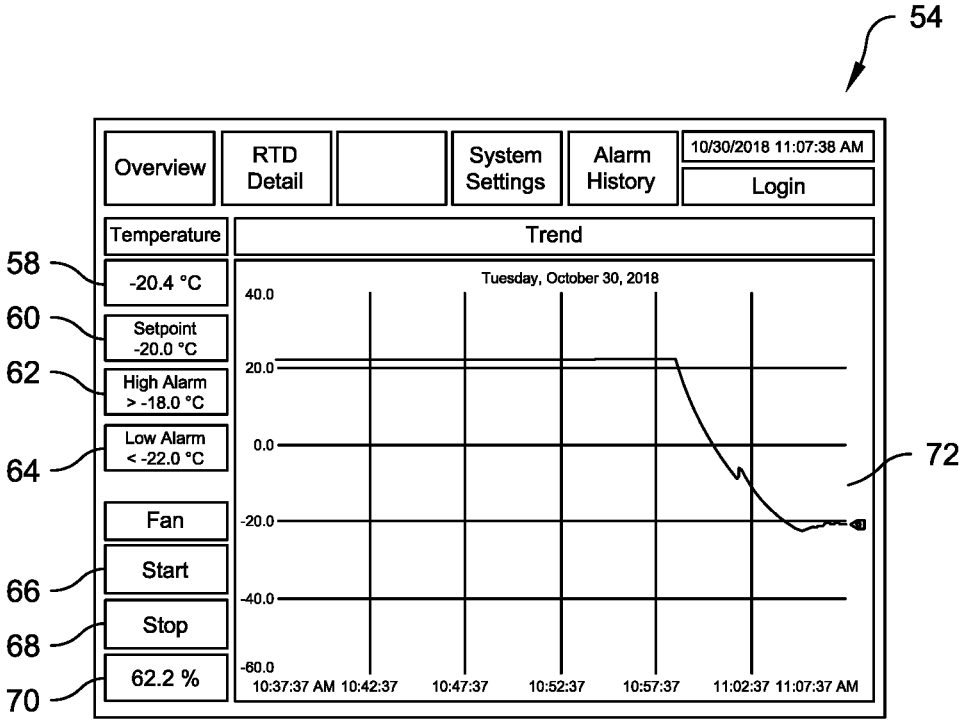
FIG. 9 is a graphical user interface of the control unit of FIG. 1 after the fan has been started in accordance with one embodiment of the presently disclosed technology.

In the example shown in FIGS. 8 and 9, the current temperature within the chimney 16 (e.g., the average of the eight sensors 50) may be displayed on the display screen 54 at location 58, the desired temperature set point may be set and displayed at location 60 on the display screen 54, and the acceptable upper and lower limits of the set point temperature (e.g., ±3° C.) may be set and displayed at locations 62, 64 on the display screen 54. In addition, manual fan start and stop controls may be provided and displayed at locations 66, 68 on the display screen 54 and the percent of fan speed or flow rate relative to a maximum speed or rate may be displayed at location 70 on the display screen 54. The display screen 54 may also display one or more graphs 72 showing the temperature within the chimney 16 as recorded over a period of time. Of course, the display screen 54 could have more or fewer buttons or controls that shown and described herein.

By way of example, and not by way of limitation, a vial labeling procedure of the presently disclosed technology may include the following steps. The control unit 14 may be plugged into a power supply or source and switched to a powered-on condition. At this point, the fan unit 48 is off and the valve 50 is in the closed or downward position. A display such as shown in FIG. 8 may be provided by or on the control unit 14. In this particular example, the ambient or current room temperature is 22.2° C. (72° F.) and thus the temperature within the chimney is 22.2° C. (72° F.) as displayed at location 58 on the display screen 54. In this particular example, the set point of the desired temperature within the chimney 16 is set to −20° C. (−4° F.) and the acceptable range of temperature is set to −18° C. to −22° C. (i.e., ±2° C. about the set point) as displayed at locations 60, 62, 64 of the display screen 54. The displayed graph 72 shows that the temperature within the chimney 16 has been constant at ambient or current room temperature at 22.2° C. (72° F.).

The lid 18 can be removed from a remainder of the table 12. For example, the lid 18 can be lifted upward and off of the walls 24, 26, 28, 30. A supply of dry ice or other conditioning material or substance can be placed within the chamber 20 of the table 12 such as to substantially fill the chamber 20. Optionally the chamber 20 can be filled or substantially filed with the temperature-controlling substance (e.g., dry ice). Thereafter, the lid 18 (on which the chimney 16 with sensors 52 are mounted) can be reattached to the table 12 to close the chamber 20.

The valve 50 can then be moved (e.g., upward) to an open position to permit air flow into the chamber 20 via the air-intake opening 46 in the end wall 30 of the table 12. According to one embodiment, the valve 50 may be manually operated and include the valve handle 74 (see FIG. 4), which may be gripped by the user and pulled upwardly to withdraw a valve plate from covering the opening 46 into the chamber 20 and, thereby, allow passage of air into the chamber 20. At this point, the control unit 14 can be used to turn the fan on and force a flow of ambient air into the chamber 20 via the opening 46 in the end wall 30 of the table 12.

By way of example, FIG. 9 shows the display screen 54 displaying a graph 72 showing the temperature within the chimney 16 falling from room temperature to the set point temperature over a period of time. Optionally, the control unit 14 can programmed to automatically maintain the temperature within the chimney 16 at the set point between the set upper and lower limits. Thus, the control unit 14 can increase or reduce the fan speed or air flow speed to maintain the set point temperature. For instance, as shown in FIG. 9, the current temperature within the chimney 16 is −20.4° C. and fan speed or air flow rate is at 62.2% of a maximum fan speed or air flow rate. Optionally, when the temperature within the chimney reaches the set temperature range, the light 56 can turn off, signaling to the worker that the table 12 is ready and safe for use.

Figure 10:
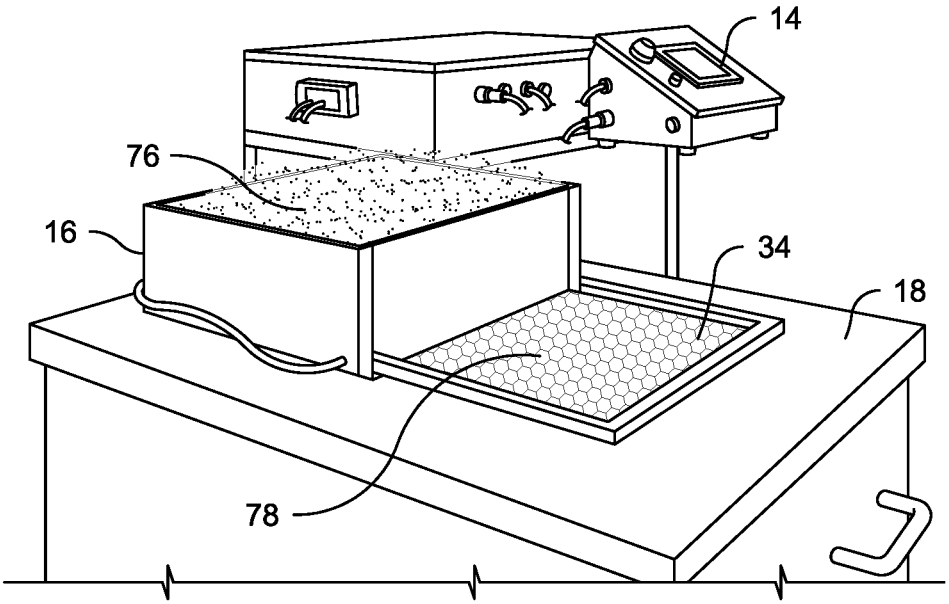
FIG. 10 is another perspective view of the packing table and control unit of FIG. 1 with a fog of cool air located in the chimney of the packing table.

At this time, as shown in FIG. 10, a fog, mist, or flow 76 of cold air and/or $CO_2$ can move upward and into the chimney 16. Optionally, a vial tray or the like may be placed on a part 78 of the screen 34 extending exterior and adjacent the chimney 16 (through which there is no cold air flow). The end wall 42 of the chimney 16 may be opened (e.g., moved upwardly) to enable the vials, for example, to be slid into the temperature-controlled area defined within the chimney 16 and then the end wall 42 of the chimney 16 may be closed (e.g., moved downwardly) when the vials are completely within the temperature-controlled area. As an example, the worker is then able to label the vials while the vials are located within the temperature-controlled area within the chimney 16 by extending only their gloved hands into the temperature-controlled area defined by the chimney 16.

The dry ice or other substance within the chamber 20 may be checked and refilled at desired intervals, such as in 2 hour intervals, and when an operation is complete, the fan "Stop" button can be used to stop the fan and the valve 50 may be positioned into a closed condition. The lid 18 may be fully removed from the table 12 to permit any remaining dry ice or like substance to evaporate or be removed and recovered.

In one optional embodiment, the single control unit 14 can operate and be connected to two or more separate and independent tables 12. In particular, in such an embodiment, the control unit 14 can independently operate each of the tables 12 at the same time, for example by toggling an HDMI or touch screen display to tell the control unit 14 which of the tables 12 to communicate with to set the temperature and/or evaluate performance.

Figure 13:
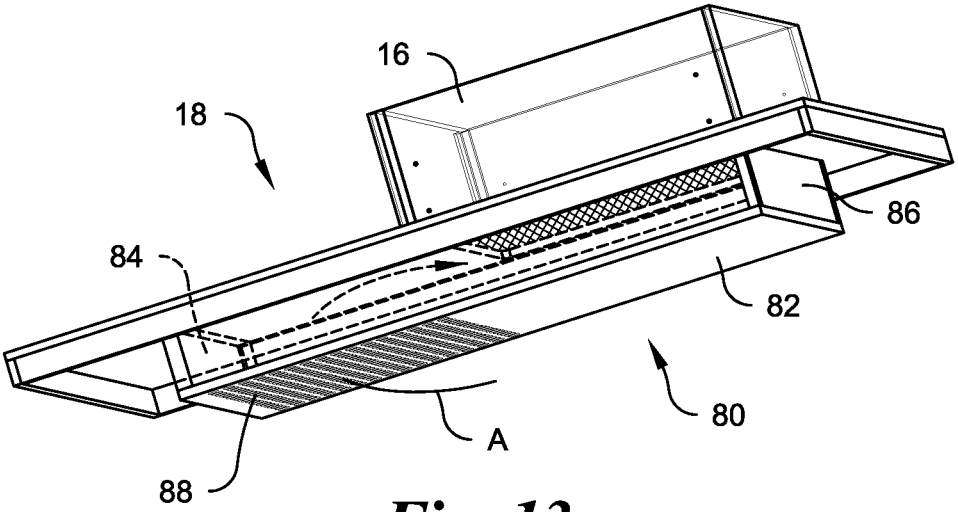
FIG. 13 is a bottom perspective view of a lid of the packing table according to one embodiment of the present disclosure.

In an optional embodiment, as shown in FIG. 13, the lid 18 can include one or more baffles or flow-directors 80. The baffle 80 can optionally be located beneath and attach to the lid 18. The baffle 80 can be designed and/or configured to encourage or force air flow in a particular direction or pattern (e.g., see arrow in FIG. 13) to optimize use of the table 12 and/or the temperature-controlling substance. In operation, it can be important for the cold air or $CO_2$ to swirl around inside the table 12 and move away from the air intake opening 46. The baffle 80 helps accomplish this functionality. The baffle 80 also helps to prevent uneven or premature melting of the temperature-controlling substance, and prevents the cold air or $CO_2$ from taking the path of least resistance (e.g., directly upwardly) from the inside of the air intake opening 46 to out of the chimney 16. As a result, a more balanced mixture of cold air or $CO_2$ is produced within or from the table 12 by use of the baffle 80.

Optionally, the baffle 80 can include a first portion or wall 82 that is planar and extends parallel to the top surface of the lid 18, a second portion or end wall 84 that is planar and extends perpendicular to the top surface of the lid 18 and the first portion 82, and a third portion or end wall 86 that is planar and extends perpendicular to the top surface of the lid and the first portion 82. The second and third portions 84, 86 can extend parallel to one another, and from the first portion 82 upwardly to an underside of the lid 18. The baffle 80 can also include a fourth portion or sidewall and a fifth portion or sidewall that, in combination with the first, second, and third portions, create a cavity. The fourth and fifth portions are unnumbered and shown as transparent in FIG. 13 for clarity only so as to more clearly depict the functionality of the baffle 80.

The first portion 82 of the baffle 80 can include an opening 88 extending therethrough. In FIG. 13, the opening 88 is shown to have a square or rectangular shape. However, the presently disclosed technology is not limited to such a configuration, as the opening 88 can have other shapes. The opening 88 can include or be covered by a screen or filter. The opening 88 is optionally laterally or horizontally off-set or spaced from the chimney 16. Such an arrangement can encourage circulation of air within the table 12, such as shown by the directional arrow A in FIG. 13. When the lid 18 is properly attached to the top of the walls 24, 26, 28, 30, the chimney 16 is optionally located closer to the air intake opening 46 than the opening 88 of the first portion 82 of the baffle 80.

Figure 14:
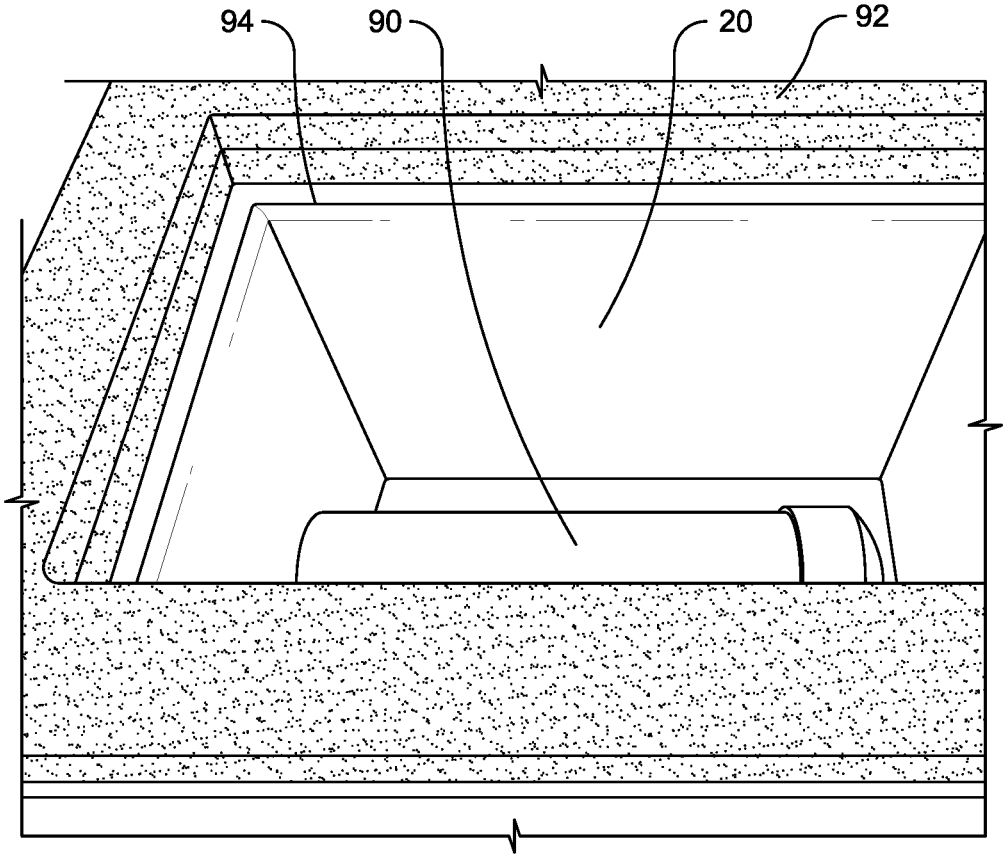
FIG. 14 is a top perspective view of a portion of the packing table according to one embodiment of the present disclosure.
Figure 15:
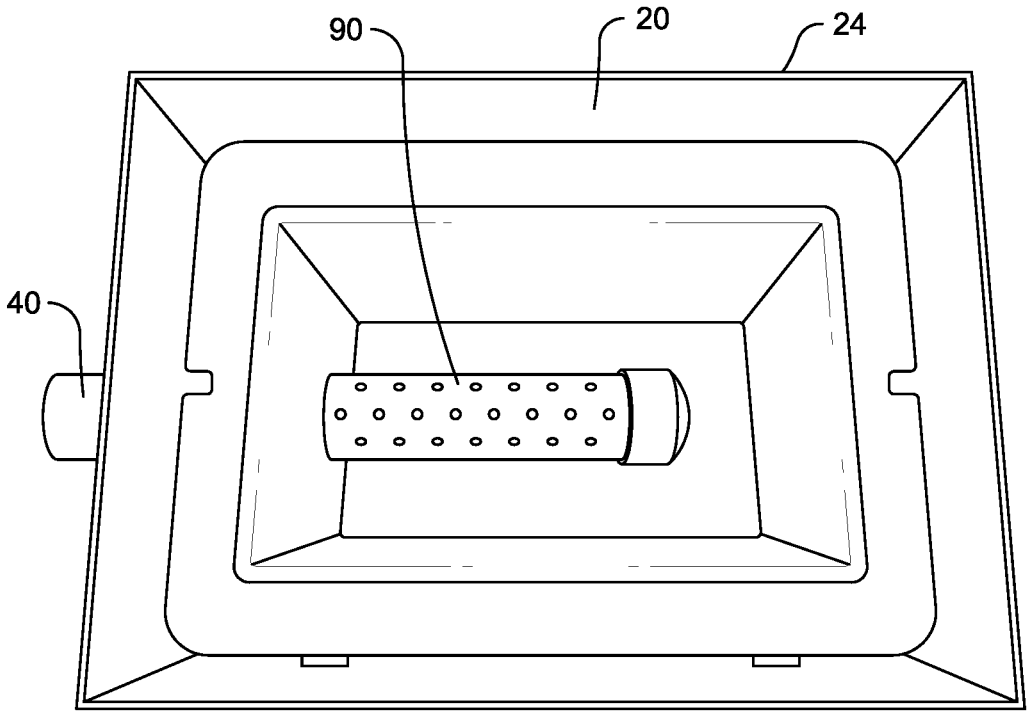
FIG. 15 is a magnified top perspective view of a portion of the packing table according to one embodiment of the present disclosure, wherein an inlet extension is shown in a rotated position for clarity only.

In an optional embodiment, as shown in FIGS. 14 and 15, the table 18 can include an inlet extension 90 within the cavity 20. The inlet extension 90 can extend from the air intake opening 46 on a side of the table 12 inward into and optionally past a mid-point of the cavity 20. Optionally, the inlet extension 90 can be in the form of a cylinder (e.g., a PVC tube or pipe). The inlet extension 90 can function as a pre-conditioner of the incoming air into the cavity 20 and promote even sublimation of the temperature-controlling substance. The inlet extension 90 helps avoid hot spots and results in the level of temperature-controlling substance dropping evenly and more predictably when calculating refill intervals than without the inlet extension 90.

As shown in FIG. 15, the inlet extension 90 can include a plurality of holes extending through a periphery thereof. Optionally, one or a plurality of rows of holes extend through a portion of the inlet extension 90. Each row can be directed or pointed downwardly (opposite of what is depicted in FIG. 15, which is shown this way for clarity only and ease of illustration). In one embodiment, inlet extension 90 includes three spaced-apart rows of holes pointed downward toward a bottom of the cavity 20. Optionally, the center row of holes is positioned at six o'clock, and the other two rows of holes are positioned at four and eight o'clock, respectively. In one embodiment, each hole in every row is exactly or approximately the same size or had the same diameter. The holes help prevent burning or using the temperature-controlling substance unevenly and/or directly next to the air intake opening 46, which would contribute or create inconsistent cold air flow.

Figure 12:
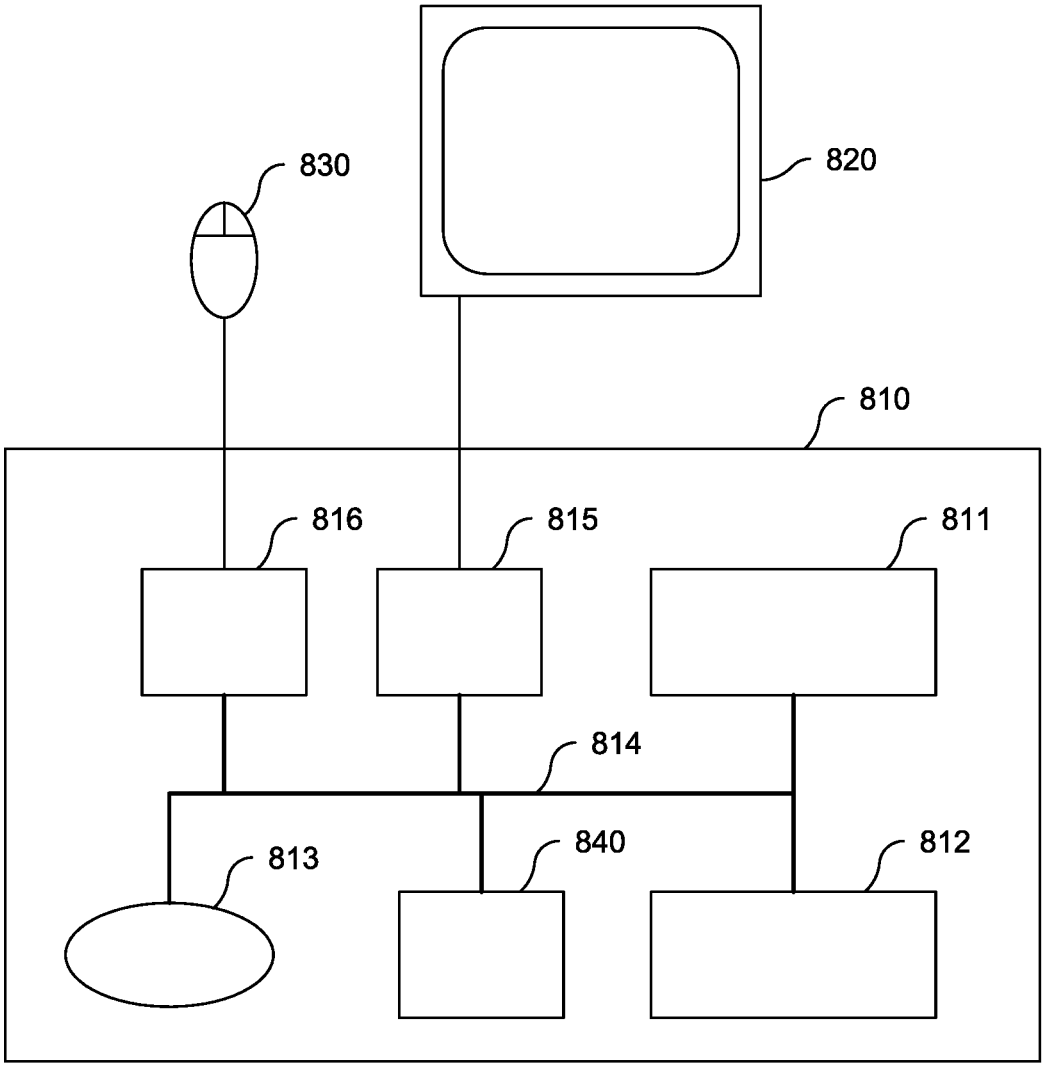
FIG. 12 is a schematic diagram of a computing system of one embodiment of the present disclosure.

One or more of the above-described techniques and/or embodiments can be implemented with or involve software, for example modules executed on one or more computing devices 810 (see FIG. 12). Optionally, the control unit 14 includes at least one computing device 810. Of course, modules described herein illustrate various functionalities and do not limit the structure or functionality of any embodiments. Rather, the functionality of various modules may be divided differently and performed by more or fewer modules according to various design considerations.

Each computing device 810 may include one or more processing devices 811 designed to process instructions, for example computer readable instructions (i.e., code), stored in a non-transient manner on one or more storage devices 813. By processing instructions, the processing device(s) 811 may perform one or more of the steps and/or functions disclosed herein. Each processing device may be real or virtual. In a multi-processing system, multiple processing units may execute computer-executable instructions to increase processing power.

The storage device(s) 813 may be any type of non-transitory storage device (e.g., an optical storage device, a magnetic storage device, a solid state storage device, etc.). The storage device(s) 813 may be removable or non-removable, and may include magnetic disks, magneto-optical disks, magnetic tapes or cassettes, CD-ROMs, CD-RWs, DVDs, BDs, SSDs, or any other medium which can be used to store information. Alternatively, instructions may be stored in one or more remote storage devices, for example storage devices accessed over a network or the internet.

Each computing device 810 additionally may have memory 812, one or more input controllers 816, one or more output controllers 815, and/or one or more communication connections 840. The memory 812 may be volatile memory (e.g., registers, cache, RAM, etc.), non-volatile memory (e.g., ROM, EEPROM, flash memory, etc.), or some combination thereof. In at least one embodiment, the memory 812 may store software implementing described techniques.

An interconnection mechanism 814, such as a bus, controller or network, may operatively couple components of the computing device 810, including the processor(s) 811, the memory 812, the storage device(s) 813, the input controller(s) 816, the output controller(s) 815, the communication connection(s) 840, and any other devices (e.g., network controllers, sound controllers, etc.). The output controller(s) 815 may be operatively coupled (e.g., via a wired or wireless connection) to one or more output devices 820 (e.g., a monitor, a television, a mobile device screen, a touch-display, a printer, a speaker, etc.) in such a fashion that the output controller(s) 815 can transform the display on the output device 820 (e.g., in response to modules executed). The input controller(s) 816 may be operatively coupled (e.g., via a wired or wireless connection) to one or more input devices 830 (e.g., a mouse, a keyboard, a touch-pad, a scroll-ball, a touch-display, a pen, a game controller, a voice input device, a scanning device, a digital camera, etc.) in such a fashion that input can be received from a user.

The communication connection(s) 840 may enable communication over a communication medium to another computing entity. The communication medium conveys information such as computer-executable instructions, audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

FIG. 12 illustrates the computing device 810, the output device 820 (which may be the same as or different than the display 54 described above), and the input device 830 as separate devices for ease of identification only. However, the computing device 810, the output device(s) 820, and/or the input device(s) 830 may be separate devices (e.g., a personal computer connected by wires to a monitor and mouse), may be integrated in a single device (e.g., a mobile device with a touch-display, such as a smartphone or a tablet), or any combination of devices (e.g., a computing device operatively coupled to a touch-screen display device, a plurality of computing devices attached to a single display device and input device, etc.). The computing device 810 may be one or more servers, for example a farm of networked servers, a clustered server environment, or a cloud service running on remote computing devices.

In one embodiment, the presently disclosed technology is directed to a non-transitory computer-readable medium having computer-readable code stored thereon that, when executed by one or more computing devices, causes the one or more computed devices to perform the one or more methods disclosed or claimed herein.

The following exemplary embodiments further describe optional aspects of the presently disclosed technology and are part of this Detailed Description. These exemplary embodiments are set forth in a format substantially akin to claims (e.g., each with numerical designations followed by a letter), although they are not technically claims of the present application. The following exemplary embodiments refer to each other in dependent relationships as "embodiments" instead of "claims."

1A. A system for labeling products comprising a table including an insulated chamber configured to hold dry ice and a top surface with an opening extending therethrough, the opening being surrounded by a chimney extending upwardly from the top surface, a screen above the top surface and extending parallel to the top surface, at least a portion of the screen extending into an area defined by the chimney, at least a portion of the screen extending outwardly beyond the area defined by the chimney, 2A. The system of embodiment 1A, wherein at least one wall of the chimney is movable with respect to remaining walls of the chimney such that product can be moved beneath the at least one wall into and out of the area defined by the chimney.

1B. A table comprising an insulated chamber configured to hold dry ice and a top surface with an opening extending therethrough, the opening being surrounded by a chimney extending upwardly from the top surface, a screen positioned above the top surface and extending parallel to the top surface, at least a portion of the screen extending into an area defined by the chimney, at least a portion of the screen extending outwardly beyond the area defined by the chimney, at least one wall of the chimney being movable with respect to remaining walls of the chimney such that product can be moved beneath the at least one wall into and out of the area defined by the chimney.

While the presently disclosed technology has been described in detail and with reference to specific examples thereof, it will be apparent to one skilled in the art that various changes and modifications can be made therein without departing from the spirit and scope thereof. It is understood, therefore, that the presently disclosed technology is not limited to the particular embodiments disclosed, but it is intended to cover modifications within the spirit and scope of the present presently disclosed technology as defined by the appended claims.

I claim:

1. A system configured to allow a user to prepare or package temperature-sensitive product without requiring the user to enter a harsh environment, the system comprising:

a table defining or surrounding an insulated chamber configured to hold a temperature-controlling substance, a lid removably attachable to a top of sidewalls of the table to enclose the chamber, the lid defining a planar surface and including an opening extending therethrough, a chimney surrounding the opening and extending upwardly from the lid, a screen extending above and parallel to the planar surface of the lid, the screen being configured to support temperature-sensitive product thereon, wherein at least a portion of the screen extends into an area surrounded by the chimney, the screen being configured to support a container holding temperature-sensitive product above the chamber while permitting the passage of conditioned air therethrough, and wherein at least a portion of the screen extends outwardly beyond the area surrounded by the chimney.

2. The system according to claim 1, further comprising:

a baffle attached to a bottom surface of the lid, the baffle being configured to encourage circulation of air within the table when the lid is attached to the table.

3. The system according to claim 1, further comprising:

an inlet extension extending inwardly into the chamber, the inlet extension including a row of holes configured to encourage circulation of air within the table.

4. The system according to claim 1, further comprising:

a fan unit attachable to the table, the fan unit configured to circulate air from outside the table to the insulated chamber; and a control unit operatively connected to the fan unit, the control unit configured to control operation of the fan unit.

5. The system according to claim 4, wherein at least one temperature sensor is mounted within the chimney and is configured to provide the control unit with information about the air temperature within the chimney.

6. The system according to claim 4, wherein said control unit includes a touch screen or data entry device for setting a set point air temperature or temperature range desired within the chimney and for turning on or off the fan unit.

7. The system according to claim 4, wherein the control unit is configured to maintain air temperature within the chimney within a set range.

8. The system according to claim 4, wherein the control unit comprises:

one or more processors; and one or more memories operatively coupled to the one or more processors and having computer readable instructions stored thereon which, when executed by at least one of the one or more processors, causes the at least one of the one or more processors to:

a) receive information obtained from one or more sensors attached to the table; and b) control a speed of the fan unit based on the received information.

9. The system according to claim 1, wherein at least one wall of the chimney is movable with respect to another wall of the chimney to permit movement of the container holding temperature-sensitive product beneath the at least one wall and into the area surrounded by the chimney.

10. The system according to claim 1, wherein the chimney comprises four walls, each wall extending perpendicularly to the lid, each adjacent pair of walls extending perpendicularly to one another.

11. The system according to claim 1, wherein the temperature-controlling substance is dry ice.

* * * * *